United States Patent [19]

Mills

[11] 4,417,799

[45] Nov. 29, 1983

[54] DISPOSABLE MANUALLY OPERABLE FILM PROCESSOR

[75] Inventor: Loring K. Mills, Hampton, N.H.

[73] Assignee: Polaroid Corporation, Cambridge, Mass.

[21] Appl. No.: 414,794

[22] Filed: Sep. 3, 1982

[51] Int. Cl.[3] ..... G03D 5/06

[52] U.S. Cl. ..... 354/304; 354/313; 354/318

[58] Field of Search ..... 354/303, 304, 305, 312, 354/313, 314, 317, 318

[56] References Cited

U.S. PATENT DOCUMENTS

| | | | |
|---|---|---|---|
| 3,153,376 | 10/1964 | Miller | 354/313 |
| 3,260,186 | 7/1966 | Lowell | 354/313 |
| 4,307,955 | 12/1981 | Cocco et al. | 354/303 |
| 4,309,100 | 1/1982 | Bendoni et al. | 354/303 |
| 4,370,045 | 1/1983 | Holmes | 354/313 |

*Primary Examiner*—A. A. Mathews

*Attorney, Agent, or Firm*—Alfred E. Corrigan

[57] ABSTRACT

A disposable, manually operable, film processor of the type which is adapted to superpose the emulsion side of an exposed strip of self-developing transparency type film with a length of sheet material having a layer of processing composition thereon and wind the resulting laminate upon a take-up roller until visible images have been formed in the film. After formation of the visible images, the laminate is unwound from the take-up roller and the film stripped from the sheet material and directed outside of the processor. An interlock is provided for insuring that the processor's loading door is opened before the laminate can be unwound thereby insuring the movement of the film to the exterior of the processor.

19 Claims, 7 Drawing Figures

DISPOSABLE MANUALLY OPERABLE FILM PROCESSOR

BACKGROUND OF THE INVENTION

1. Field of the Invention

This invention relates to disposable, manually operable, apparatus for processing individual rolls of 35 mm instant or self-developing type transparency film.

2. Description of the Prior Art

The present invention relates to apparatus for use by the amateur photographer in the processing of a photographically exposed roll of 35 mm instant or self-developing type transparency film and, more particularly, to such apparatus which is manually operable, compact and constructed from inexpensive materials such that it may be disposed of after its original processing materials have been depleted.

Compact film processors which are specifically constructed for use by the amateur photographer are well known. One example of such a processor is described in U.S. Pat. No. 3,153,376. This processor, which is disclosed as being made of a lightweight plastic and may be made disposable, includes an arrangement wherein an exposed sheet of photosensitive material and an image-receiving sheet are simultaneously manually withdrawn from their respective rollers within the processor, moved through a bath of developing fluid, and are then superposed as they are moved to the exterior of the processor via a film opening in a wall of the processor. After the latent image in the film has diffused to the image-receiving sheet and been chemically reduced so as to produce a visible image, the resulting photographic prints are stripped from the film thereby leaving the operator with the resultant problem of what to do with the film (photosensitive sheet) and any residue (which may be toxic) of the development process. Several embodiments of the processor are described including one wherein a container of developing liquid is punctured in response to the processor's loading door being moved into a closed position. However, all of the described embodiments contain the above-described problem of what to do with the "garbage" which is left in the user's hand after the film has been processed.

U.S. Pat. No. 3,260,186 discloses a manually operable, compact, handheld film processor which includes a first chamber for receiving a film cassette containing a strip of exposed film, a second chamber containing a take-up reel to which the leader of the film is to be attached, and a third chamber, located intermediate the first and second chambers, into which a processing paste is to be squeezed for subsequent application to the emulsion side of the film. The exposed film is processed by rotating the take-up reel via a crank while a tube of processing paste is being squeezed so as to move its contents into the third chamber and out of a slit therein where it is applied to the film as the latter is moved past the slit. This type of film processor requires more than a minimum amount of dexterity on the part of the operator in order to simultaneously control the speed of movement of the film and the rate at which the developing paste is to be injected into the processor. Further, after the film has been removed from the processor, it still has to be washed and hung up to dry.

Still other types of compact film processors for the amateur photographer are disclosed in U.S. Pat. Nos. 4,039,100 and 4,307,955. While these processors solve many of the problems of the earlier described film processors, they do present a cost problem vis-a-vis one which is specifically constructed to be disposed of after its processing materials have been used.

SUMMARY OF THE INVENTION

The instant invention relates to a compact, manually operable, film processor of the type which is specifically constructed from any suitable inexpensive, dimensionally stable, materials such that it may be economically disposed of after its processing materials have been depleted. In a preferred embodiment, the processor includes a housing which defines a chamber that is rendered lighttight by moving its loading door to a closed position. Mounted within the chamber is a first roller having a length of sheet material, e.g., Mylar, having a coating of gelatin on one side thereof, wound thereupon with a first end secured to the first roller. Also mounted within the chamber is a second roller to which a second end of the sheet material is attached. As the sheet material extends between the first and second rollers, it passes beneath the nozzle of an applicator which is adapted to apply a coating of processing composition to the gelatin coated side of the sheet material. The chamber is also formed so as to support a film assemblage of the 35 mm type. The film assemblage includes a film cassette containing therein a strip of exposed film. The film cassette, which is configured to be readily received by existing 35 mm cameras, is adapted to be positioned within the chamber such that the film's leader may be attached to the second roller by inserting its end between the gelatin coated surface of the sheet material and the main body of the second roller where there is less than one full wrap of the sheet material on the second roller. If there is a substantially complete wrap of the sheet material on the second roller, the end of the film is wedged between the facing surfaces of the sheet material. A rupturable container, having an amount of processing composition therein sufficient to coat substantially the entire length of the sheet material, is positioned above and in communication with the applicator.

After a film cassette has been loaded into the chamber with the leader of the exposed film attached to the second roller, the loading door is closed thereby rendering the chamber lighttight. During the movement of the door to the closed position, an elongate bar extending downwardly from the door engages and ruptures the container thereby expressing its contents into the applicator. After the door has been closed, a crank is drivingly connected to a hub of the second roller, which hub is accessible from the exterior of the processor, and manually rotated in a predetermined direction. Such rotation is effective to simultaneously withdraw the film from the cassette and the sheet material from the first roller. As the sheet material passes the applicator, a coating of the processing composition is applied to its gel coated side. Thereafter, the coated surface of the sheet material is brought into superposition with the film's emulsion side and wound as a laminate upon the second roller. The laminate is allowed to remain wound upon the second roller for a predetermined period of time, e.g., a period of time sufficient for visible images to form in the film. The loading door is then opened and the crank is engaged with a hub of the first roller, which is also accessible from the exterior of the processor, and rotated in a direction which rewinds the sheet material upon the first roller while simultaneously removing the laminate from the second roller. During the unwinding of the laminate from the second roller, the direction of movement of the sheet material is changed by approximately 180 degrees by an idler roller. This reversal of movement of the sheet material is effective to strip it and the film's emulsion layer from the image-receiving portion of the film as the beam strength of the latter causes it to continue along the original path of movement to the exterior of the processor.

In an alternative embodiment, the housing of the processor includes a compartment for containing a film assemblage which includes a roll of unexposed film. To protect the film, the compartment is hermetically sealed by a cover which also functions as a crank for rotating the first and second rollers of the processor.

An object of the invention is to provide a compact, manually operable, film processor for the amateur photographer, which processor is adapted to be disposed of after its processing materials have been depleted.

Another object of the invention is to provide a film processor of the type described with means for allowing a processed length of film to be directed to the exterior of the processor thereby enhancing its compactness.

Still another object of the invention is to provide a film processor of the type described with a loading door which not only renders the processor lighttight when it is in the closed position but which also functions to direct a member into rupturing engagement with a pod of processing composition as the loading door is moved into the closed position.

Still another object of the invention is to provide a film processor of the type described with a film cassette containing a roll of unexposed film and a compartment for hermetically enclosing the film cassette.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
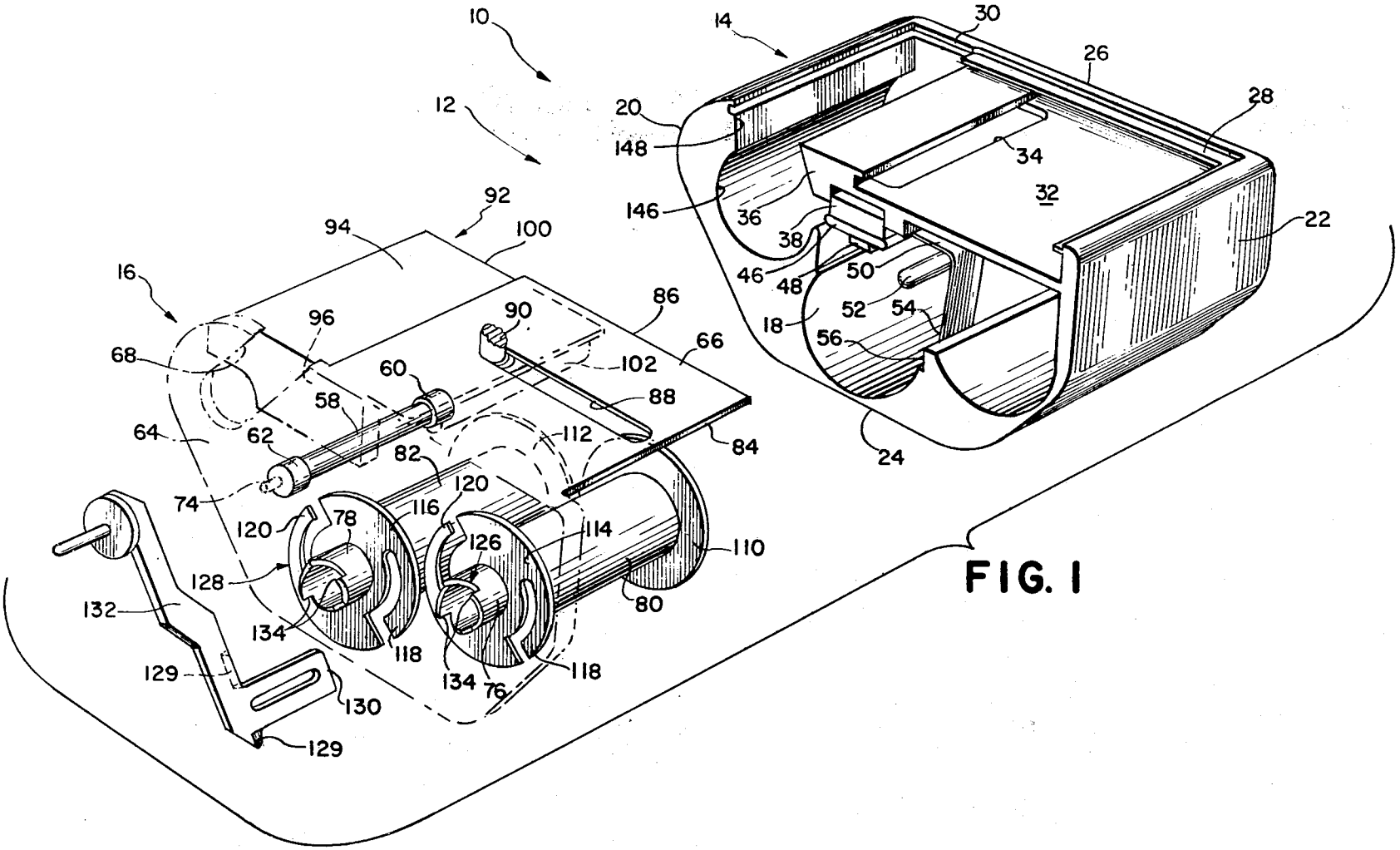
FIG. 1 is a partially exploded perspective view, with parts shown in phantom, of a preferred embodiment of a film processor sans its container of processing composition and a length of sheet material.

Reference is now made to FIGS. 1–5 of the drawings wherein is shown a preferred embodiment of a film processor 10 which is specifically adapted for use in the processing of a roll of self-developing or instant type transparency film, preferably of the 35 mm type. As best seen in FIG. 1, the processor 10 includes a housing 12 comprised of first and second housing sections 14 and 16 which define a chamber 18. The first housing section 14 includes a pair of end walls 20 and 22 which are integrally connected at their lower ends by a bottom wall 24 and at one side by a side wall 26. A lip 28 extends along the top of the end wall 22 and along a portion of the side wall 26. The remaining length of the side wall 26 is provided with a groove 30 which is located in a plane which contains the bottom surface of the lip 28. The groove 30 extends along the remainder of the side wall 26 as well as the top of the end wall 20. A generally horizontal member 32 extends inwardly from the end wall 22 and the side wall 26. The member 32 includes an opening 34 and an enlarged end portion 36. The bottom surface of the horizontal member 32 is recessed so as to receive a processing liquid applicator 38. The applicator 38 has a transversely extending nozzle 40 therein by which a layer or coating of a processing composition 42 may be applied to a length of sheet material 44 as the latter is moved past the nozzle 40. The width of the coating of processing composition to be applied to the sheet material 44 is slightly less than the distance between laterally spaced sprocket holes along opposite sides of the film, while the width of the sheet material is substantially equal to that of the film. A pressure plate 46 having length and width dimensions at least equal to the corresponding dimensions of the nozzle 40 is positioned below the applicator 38. The pressure plate 46 functions to urge the sheet material 44 against the nozzle 40 for controlled coating. The pressure plate 46 is resiliently biased toward the nozzle 40 by a T-shaped spring having a transversely extending portion 48 located in engagement with the pressure plate 46, an intermediate portion 50 which is supported by a pin 52 which extends inwardly from the side wall 26, and an end 54 located in a recess 56. A second pin (not shown) extends inwardly from the side wall 26 and is adapted to enter a hole in one end of a roller 58 so as to rotatably support that end of the roller 58. The roller 58 includes a pair of collars 60 and 62 which are spaced from each other by a distance substantially equal to the width of the nozzle 40 whereby only the laterally spaced sides of the sheet material, i.e., the non-coated surfaces, are engaged by the collars 60 and 62. Accordingly, when the sheet material 44 having a coating of the processing composition 42 thereon is moved into superposition with the exposed film, the shoulders prevent the processing composition 42 from being squeezed laterally into the sprocket holes in the film. Thus, the processing composition 42 is not squeezed in a lateral direction when the sheet material 44 is brought into contact with the film.

The second housing section 16 includes a side wall 64 (shown in phantom lines in FIG. 1) and a top wall 66. The side wall 64 has an open-ended slot 68 therein which is adapted to receive the large journal 70 of a film spool located within a film cassette 72 so as to insure correct loading of the cassette 72 into the apparatus 10. An integrally molded pin 74 extends inwardly from the side wall 64 and is adapted to be received by a hole in the adjacent end of the roller 58 so as to rotatably support that end of the roller 58. Further, the side wall 64 is provided with a pair of openings (not shown) which are adapted to rotatably support the journals 76 and 78 of first and second rollers 80 and 82, respectively. The opposite side wall 26 is formed with annular bearings (not shown) in its interior surface for rotatably supporting the journals (not shown) on the opposite ends of the first and second rollers 80 and 82.

The peripheral edges 84 and 86 of the top wall 66 of the second housing section 16 are adapted to be supported by the lip 28 when the first and second housing sections 14 and 16 are secured to each other. The top wall 66 also includes a longitudinally extending slot 88 which is adapted to receive a pin 90 which extends upwardly from a loading door 92.

Figure 2:
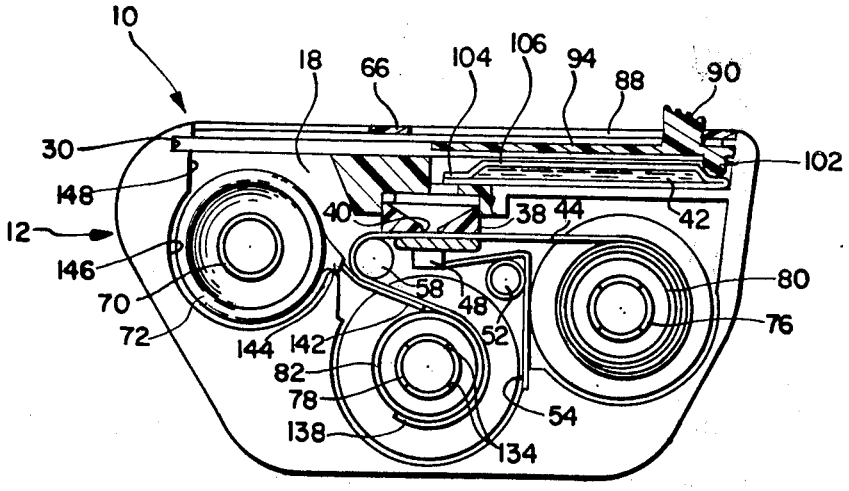
FIG. 2 is a side elevational view, partly in section, of the processor shown in FIG. 1 with a film cassette containing a length of exposed film located in position for the film to be processed.
Figure 3:
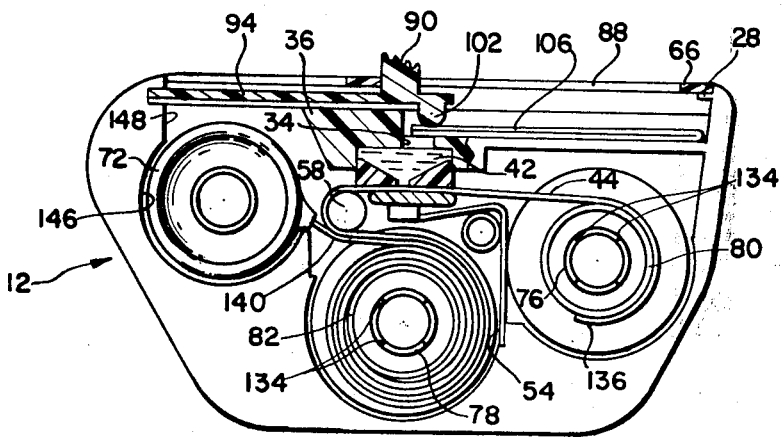
FIG. 3 is a view similar to FIG. 2 showing a laminate comprised of the exposed film and a length of sheet material wound upon a roller of the processor while a processing composition imbibes the film.

The loading door 92 includes a top wall 94 and a side wall 96. A cam 98, see FIG. 5, extends inwardly from the side wall 96. Note, the first roller 80 is shown in phantom in FIG. 4 for reasons of clarity. The interior or inwardly facing surface of the side wall 64 is provided with a longitudinally extending recess 99 for slidably supporting the side wall 96 of the loading door 92. The opposite side of the door 92, i.e., edge 100 is adapted to be slidably supported by the groove 30. Thus, the loading door 92 is slidably supported for movement between a film loading position, as shown in FIG. 2, and a closed position, as shown in FIG. 3, where it renders the chamber 18 lighttight. The loading door 92 may be provided with any suitable means for releasably retaining it in its closed position.

The loading door 92 is integrally formed on its lower surface with a transversely extending bar 102 which is adapted to rupture an end 104 of a pod or container 106 supported on the horizontal member 32 as the loading door 92 is moved toward the closed position. Thus, the processing composition 42 in the container 106 flows into the applicator 38 via the opening 34.

Figure 5:
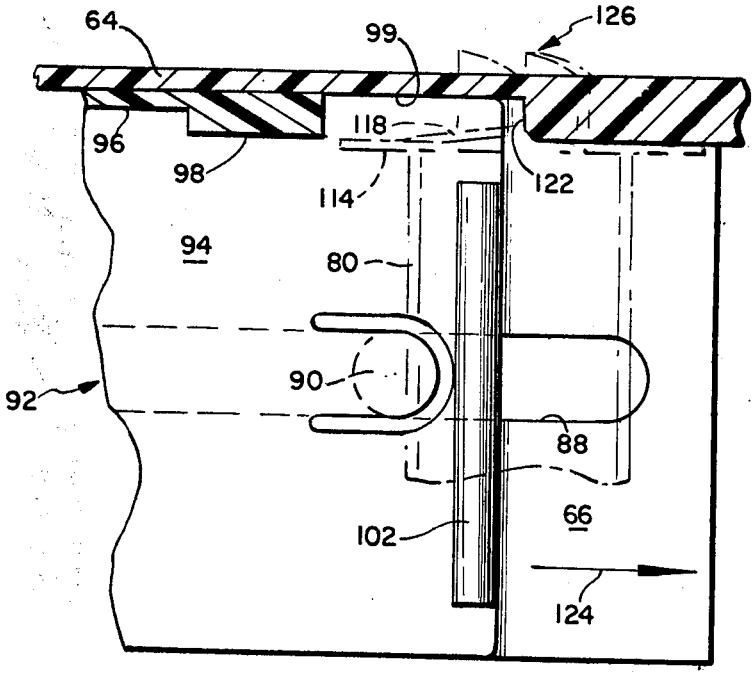
FIG. 5 is an enlarged plan view, partly in section, showing the construction whereby a first roller of the processor cannot be rotated until the processor's loading door has been opened.

Referring back to the first and second rollers 80 and 82, respectively, it will be noted that each includes a substantially planar flange 110, 112 at one end, and a split planar flange 114 and 116 at the opposite end. Each of the flanges 114 and 116 includes two resilient, circumferentially extending, cantilevered sections 118 and 120, which sections gradually emerge from the plane of their respective flanges as one moves along their lengths toward their free ends. The sections 118 and 120 of the flange 116 normally engage the interior surface of the side wall 64 thereby applying a slight resistance to the rotation of the second roller 82 so as to prevent free wheeling of the same. The corresponding sections of the flange 114 not only engage the same surface of the side wall 44 to prevent free wheeling of the first roller 80, but they also function to prevent clockwise rotation of more than 180° (as viewed in FIG. 1) of the first roller 80 until the loading door 92 has been moved into its open position. Specifically, during rotation of the first roller 80 in a clockwise direction with the loading door 92 in its closed position, one of the sections 118 or 120, e.g., section 118 will spring outwardly into the recess 99 in the side wall 64 such that further rotation of the roller 80 results in the free end of the section 118 rotating into engagement with an end wall 122 of the recess 99, as best shown in FIG. 5. Continued rotation of the first roller 80 in a clockwise manner is made possible by moving the loading door 92 in the direction of the arrow 124 thereby moving the cam 98 into engagement with the section 118. Thus, when the end of the cam 98 engages the end wall 122, the section 118 has been resiliently cammed back into the plane of the flange 114 thereby freeing the roller 80 for subsequent clockwise rotation.

The journals 76 and 78 of the first and second rollers 80 and 82, respectively, have a saw tooth configuration, generally designated by the reference characters 126 and 128, which provides a means whereby the respective roller may be driven only in a clockwise direction by the shoulders 129 on the blade 130 of a hand crank 132. Stated another way, each journal is provided with four driving surfaces 134, located 90° apart, and oppositely located surfaces 13 can only be drivingly engaged by the shoulders 129 of the blade 130 when the blade 130 is located within one of the journals 76 or 78 and the crank is rotated in a clockwise direction.

The sheet material 44, which may be a polyester film such as Mylar having a coating of gelatin on one side thereof, is coiled about the first roller 80 with a first end 136 fixedly secured to the first roller. A second end 138 of the sheet material 44 runs between the nozzle 40 and the pressure plate 46 and around the roller 58 to a point where it is attached to the second roller 82.

The processor 10 is specifically adapted to process a photographically exposed length of instant or self-developing type transparency film 140, preferably of the 35 mm format. As is well known in the art, the film 140 constitutes a part of a film assemblage which includes a generally cylindrically configured film cassette 72 having a film spool (not shown) rotatably supported therein. The film 140 is coiled about the film spool with its first end secured to the film spool and its second end 142 extending to the exterior of the film cassette 72 via a film withdrawal slot 144.

In one prototype of a processor built in accordance with the foregoing description, its length, width and height measurements in centimeters was 9.875, 5 and 5.5, respectively. Accordingly, it can readily be understood that the processor 10 may be supported by a desk top or work bench during processing of a length of exposed film or, alternatively, it may be held in one hand while the operator used his other hand to rotate the crank.

Figure 4:
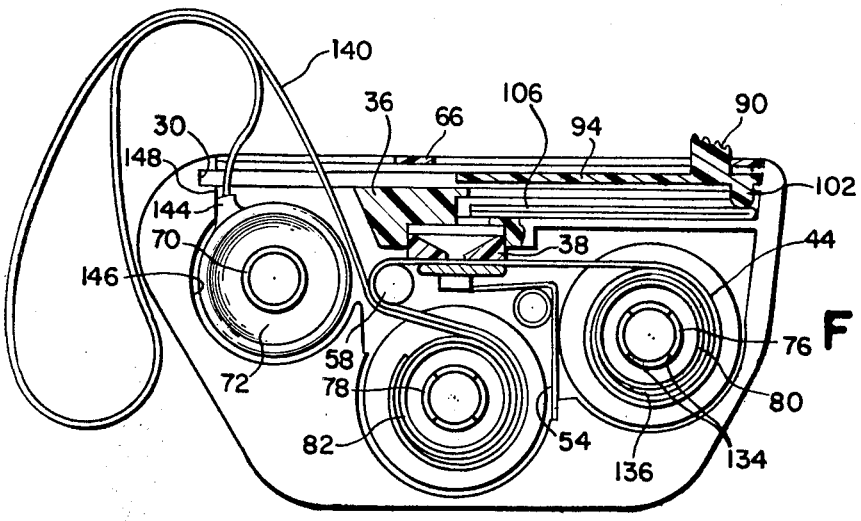
FIG. 4 is a view similar to FIG. 3 depicting a latter time in the processing of the exposed film.

When it is desired to process the exposed film 140, the film cassette 72 is placed within a compartment 146 of the processor 10 such that the longer of the film spool's journals, heretofore designated as 70, is received by the open ended slot 68 in the side wall 64. The compartment 146 is configured to receive the film cassette 72 only when the journal 72 is located in the slot 68 thereby insuring that the emulsion side of the film 140 is facing the roller 58. Also, the second end 142 of the film 140 is wedged between the surface of the second roller 82 and the gelatin coated surface of the sheet material 44, as best shown in FIG. 2. The operator then moves the loading door 92 into its closed position thereby rendering the chamber 18 lighttight while simultaneously causing the bar 102 to rupture the end 104 of the container 106 thus expressing the processing composition 42 therefrom. The processing composition 42 flows into the applicator 38 via the opening 34. The operator then attaches the crank 132 to the exteriorly available drivable means of the second roller 82, i.e., to the driving surfaces 134 on the end of the journal 78, and rotates the second roller in a clockwise direction. Such rotation is effective to withdraw the film 140 from its film cassette 72 and superpose it with the sheet material 44 so as to define a laminate which is wound upon the second roller 82. The aforementioned laminate includes a layer or coating of processing composition 42 located between the film and the sheet material, the coating having been applied to the gelatin coated side of the sheet material 44 as it was moved past the nozzle 40 of the applicator 38. The winding of the laminate upon the second roller 82 is continued until the film 140 can no longer by withdrawn from the film cassette 72. The laminate is now allowed to remain wound upon the second roller for a predetermined period of time, i.e., for a period of time sufficient for the processing composition 42 to imbibe the film 140 and produce visible images in the film. At the end of this period of time the crank 132 is used to rotate the first roller 80 in a clockwise direction so as to rewind the sheet material 44 upon the first roller 80. However, as previously described, this cannot be accomplished until the operator first moves the loading door 92 back into its open position. As the first roller 80 is rotated in a clockwise direction, the laminate consisting of the film 140 and sheet material 44 is unwound from the second roller 82. During the passage of the laminate past the roller 58, the direction of movement of the sheet material 44 is substantially reversed while the beam strength of the film 140 causes it to continue toward the location previously occupied by the loading door 92 when it was in its closed position, thereby resulting in the processed film 140 being stripped from the sheet material and being directed to the exterior of the processor 10, as shown in FIG. 4. During the movement of the film 140 to the exterior of the apparatus 10, the film 140 causes the film cassette 72 to rotate in a counterclockwise direction until the exit or withdrawal slot 144 engages a stop 148.

The film 140 preferably includes a plurality of layers including, in sequence, a transparent base through which an exposure is made, an additive color screen, an image receiving layer, a stripping layer, and a photosensitive layer. It will be noted from FIG. 3 that as the sheet material 44 and the film 140 are brought into contact with each other at the roller 58, it is the layer of the film which is most distant from the transparent base that is placed in intimate contact with the surface of the sheet material 44 having the layer of processing composition 42 coated thereon. Subsequent to the processing composition 42 being imbibed by the film 140, the photosensitive layer or emulsion exhibits a greater adhesion to the spreader sheet 44 than to the next adjacent layers whereby removal of the spreader sheet 44 serves to remote the photosensitive layer thus increasing visual acuity and brightness of the resultant positive transparency and enhancing its stability by virtue of the removal of residual processing reagent in the photosensitive layer. In this regard, the stripping layer is employed to facilitate removal of the photosensitive layer. For further details of the film, reference may be had to U.S. Pat. No. 3,682,637 granted to E. H. Land on Aug. 8, 1972.

After the sheet material 44 has been completely stripped from the film, the latter may be severed from its connection to the film spool for subsequent editing and mounting in individual frames. The loading door 92 may then be closed thereby safely enclosing any by-products, that may be left from the processing operation prior to disposing of the processing apparatus 10.

Figure 6:
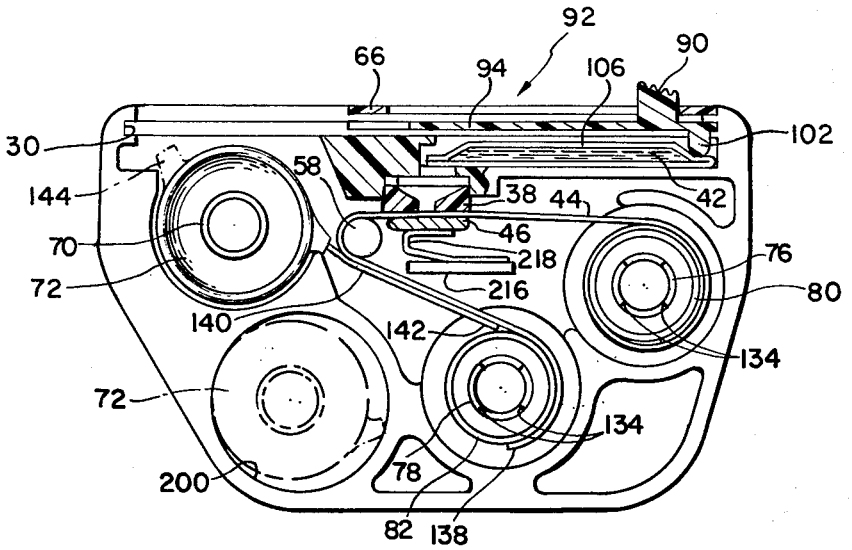
FIG. 6 is a side elevational view, partly in section, of an alternative embodiment of a film processor.
Figure 7:
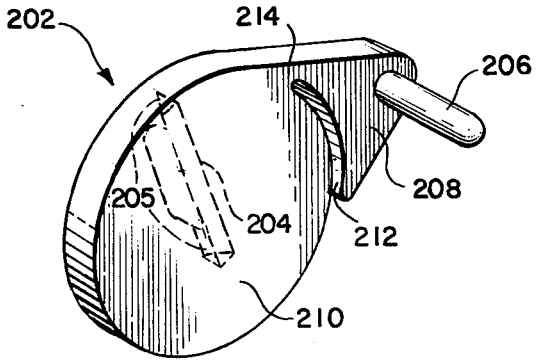
FIG. 7 is an enlarged perspective view of a cover which functions not only to seal a compartment of the processor of FIG. 6 but also as a means for rotating the rollers of the processor.

Reference is now made to FIGS. 6 and 7 of the drawings wherein is shown an alternative embodiment of the invention. Specifically, FIG. 6 shows a small, compact, manually operable, disposable film processor 10'. The processor 10' is similar to that previously described except that the location of the first and second rollers 80 and 82 have been changed so as to provide room in the processor 10' for a compartment 200 which is adapted to house a film cassette 72 containing therein a roll of unexposed film 140. Also, the side wall (not shown) which corresponds to the side wall 64 of the previously described processor 10 includes an additional opening by which the film cassette 72 containing the unexposed film may be removed from the compartment 200. Further, the opening to the compartment 200 is defined by an annular lip over which a cover 202, formed from a plastic material, is adapted to be positioned so as to hermetically seal the film assemblage within the compartment 200. The processor 10' is purchased over the counter with the various elements or components positioned as shown in FIG. 6 and with the film cassette 72 being located within the compartment 200, as depicted in phantom lines. The operator then unwraps the processor 10', removes the cover 202, and removes the film cassette 72 from the compartment 200 for subsequent exposure in a camera. After the film 140 has been exposed, rewound into its film cassette 72, and then removed from the camera, the film cassette is then placed within the processor 10', as shown in solid lines, and its leading end 142 attached to the second roller 82 in the same manner as described above with respect to the processor 10. Next, the operator closes the loading door 92 thereby rendering the processor 10' lighttight while simultaneously rupturing the container 106 and expressing its contents, i.e., the processing composition 42, into the applicator 38. Now, the cover 202 is used in place of the crank 132 to rotate the second roller 82 in a clockwise direction. Specifically, a blade 204, which extends inwardly from a face of the cover 202, is located within the hollow jounral 78 such that a pair of beveled shoulders 205 are in engagement with two diametrically opposed driving surfaces 134 and the cover is driven by a handle 206. The handle 206 extends from a triangular shaped portion 208 of the cover 202 which in turn is separated in part from the main body 210 of the cover 202 by a slit 212. Thus configured, the only connection between the main body 210 and the portion 208 is a living hinge 214. Thus, if one attempts to rotate the cover in a clockwise direction, the slit 212 closes and the force being transmitted to the portion 208 by the handle 206 is transmitted to the main body 210. However, if the operator attempts to rotate the cover 202 in the opposite direction, the portion 208 merely rotates about the living hinge 214. The remainder of the processing cycle is exactly the same as that described with reference to the processor 10. Also, one other change in the processor 10' is the means for resiliently biasing the pressure plate. Herein, a flange 216 extends inwardly from the side wall of the processor for supporting a spring 218 in engagement with the pressure plate 46.

Since certain changes may be made in the above apparatus without departing from the scope of the invention herein involved, it is intended that all matter contained in the above description or shown in the accompanying drawings shall be interpreted as illustrative and not in a limiting sense. For example, while the crank 132 has been shown as a separate element, it may be initially molded as an integral part of either the housing 12 or the loading door 92 and would be detached therefrom by the operator of the processor.

What is claimed is:

1. A disposable, manually operable, film processor of the type specifically constructed to be disposed of after its processing materials have been depleted, the processor being adapted for use in the processing of a length of photographically exposed, self-developing type film, said film processor comprising:

a housing defining a lighttight chamber, said housing including means defining a loading door which is movable from a closed position to an open position for providing access to said chamber, said housing including a pair of spaced side walls;

a first roller rotatably supported within said chamber by said side walls for rotation in first and second directions, said first roller including drivable means accessible exteriorly of said processor and adapted to be engaged by a manually operable member for rotating said first roller in said first direction;

a length of sheet material having first and second opposite ends, said length of sheet material being wound upon said first roller with said first end secured to said first roller and said second end being attached to a second roller;

a second roller rotatably supported within said chamber for rotation about its axis, said second roller including drivable means accessible exteriorly of said processor and adapted to be engaged by a manually operable member for rotating said second roller;

means for supporting a film assemblage of the 35 mm type containing a cassette having therein a roll of exposed self-developing type film including a leader which is adapted to extend to the exterior of the cassette via a slot therein for attachment to said second roller;

a supply of processing composition;

an applicator mounted in said chamber in communication with said supply of processing composition for applying a coating to one side of said sheet material; and a manually operable member engageable with said drivable means of said second roller for rotating it in a direction, after said loading door has been moved to said closed position, so as to unwind said sheet material from said first roller and move it past said applicator where a coating of said processing composition is applied to one side of said sheet material, said rotation of said second roller also being effective to withdraw the exposed film from its cassette and wind it upon said second roller in engagement with the coated surface of said sheet material so as to form a laminate which is to remain wound upon said second roller for a period of time sufficient for visible images to be formed in the film.

2. A disposable, manually operable, film processor as defined in claim 1 wherein said manually operable member is adapted to be engaged with said drivable means of said first roller, after said period of time has elapsed and said loading door has been moved to said open position, for rotating said first roller in said first direction thereby withdrawing said laminate from said first roller.

3. A disposable, manually operable, film processor of the type specifically constructed to be disposed of after its processing materials have been depleted, the processor being adapted for use in the processing of a length of photographically exposed, self-developing type film, said film processor comprising:

a housing defining a lighttight chamber, said housing including means defining a loading door which is movable from a closed position to an open position for providing access to said chamber;

a first roller rotatably supported within said chamber for rotation in first and second directions, said first roller including driveable means adapted to be engaged by a manually operable member for rotating said first roller in said first direction;

a length of sheet material having first and second opposite ends, said length of sheet material being wound upon said first roller with said first end secured to said first roller and said second end being attached to a second roller;

a second roller rotatably supported within said chamber for rotation about its axis, said second roller including drivable means adapted to be engaged by a manually operable member for rotating said second roller;

means for supporting a film assemblage of the 35 mm type containing a cassette having therein a roll of exposed self-developing type film including a leader which is adapted to extend to the exterior of the cassette via a slot therein for attachment to said second roller;

a supply of processing composition including a container;

an applicator mounted in said chamber in communication with said supply of processing composition for applying a coating to one side of said sheet material;

means on said loading door for causing said processing composition to leave said container as said loading door is moved toward said closed position so as to permit said processing composition to enter said applicator; and a manually operable member engageable with said drivable means of said second roller for rotating it in a direction, after said loading door has been moved to said closed position, so as to unwind said sheet material from said first roller and move it past said applicator where a coating of said processing composition is applied to one side of said sheet material, said rotation of said second roller also being effective to withdraw the exposed film from its cassette and wind it upon said second roller in engagement with the coated surface of said sheet material so as to form a laminate which is to remain wound upon said second roller for a period of time sufficient for visible images to be formed in the film.

4. A disposable, manually operable, film processor as defined in claim 3 wherein said container is rupturable.

5. A disposable, manually operable, film processor of the type specifically constructed to be disposed of after its processing materials have been depleted, the processor being adapted for use in the processing of a length of photographically exposed, self-developing type film, said film processor comprising:

a housing defining a lighttight chamber, said housing including means defining a loading door which is movable from a closed position to an open position for providing access to said chamber;

a first roller rotatably supported within said chamber for rotation in first and second directions, said first roller including drivable means adapted to be engaged by a manually operable member for rotating said first roller in said first direction;

a length of sheet material having first and second opposite ends, said length of sheet material being wound upon said first roller with said first end secured to said first roller and said second end being attached to a second roller;

a second roller rotatably supported within said chamber for rotation about its axis, said second roller including drivable means adapted to be engaged by a manually operable member for rotating said second roller;

means for supporting a film assemblage of the 35 mm type containing a cassette having therein a roll of exposed self-developing type film including a leader which is adapted to extend to the exterior of the cassette via a slot therein for attachment to said second roller;

a supply of processing composition;

an applicator mounted in said chamber in communication with said supply of processing composition for applying a coating to one side of said sheet material;

a manually operable member engageable with said drivable means of said second roller for rotating it in a direction, after said loading door has been moved to said closed position, so as to unwind said sheet material from said first roller and move it past said applicator where a coating of said processing composition is applied to one side of said sheet material, said rotation of said second roller also being effective to withdraw the exposed film from its cassette and wind it upon said second roller in engagement with the coated surface of said sheet material so as to form a laminate which is to remain wound upon said second roller for a period of time sufficient for visible images to be formed in the film; and means for preventing rotation of said first roller in said first direction by said manually operable member until said loading door has been moved into said open position.

6. A disposable, manually operable, film processor as defined in claim 5 wherein said first roller includes at one end thereof a radially extending generally planar flange and said preventing means includes a resilient portion of said flange which normally extends out of the general plane of said flange into engagement with a stop on a wall of said chamber to thereby prevent rotation of said first roller in said first direction, and said loading door includes means for camming said resilient portion into the general plane of said flange as said loading door is moved into said open position thereby enabling rotation of said first roller in said first direction.

7. A disposable, manually operable, film processor of the type specifically constructed to be disposed of after its processing materials have been depleted, the processor being adapted fo use in the processing of a length of photographically exposed, self-developing type film, said film processor comprising:

a housing defining a lighttight chamber, said housing including means defining a loading door which is movable from a closed position to an open position for providing access to said chamber;

a first roller rotatably supported within said chamber for rotation in first and second directions, said first roller including drivable means adapted to be engaged by a manually operable member for rotating said first roller in said first direction;

a length of sheet material having first and second opposite ends, said length of sheet material being wound upon said first roller with said first end secured to said first roller and said second end being attached to a second roller;

a second roller rotatably supported within said chamber for rotation about its axis, said second roller including drivable means adapted to be engaged by a manually operable member for rotating said second roller;

means for supporting a film assemblage of the 35 mm type containing a cassette having therein a roll of exposed self-developing type film including a leader which is adapted to extend to the exterior of the cassette via a slot therein for attachment to said second roller;

a supply of processing composition;

an applicator mounted in said chamber in communication with said supply of processing composition for applying a coating to one side of said sheet material;

a manually operable member engageable with said drivable means of said second roller for rotating it in a direction, after said loading door has been moed to said closed position, so as to unwind said sheet material from said first roller and move it past said applicator where a coating of said processing composition is applied to one side of said sheet material, said rotation of said second roller also being effective to withdraw the exposed film from its cassette and wind it upon said second roller in engagement with the coated surface of said sheet material so as to form a laminate which is to remain wound upon said second roller for a period of time sufficient for visible images to be formed in the film, said manually operable member being adapted to be engaged with said drivable means of said first roller, after said period of time has elapsed and said loading door has been moved to said open position, for rotating said first roller in said first direction thereby withdrawing said laminate from said first roller;

means for facilitating stripping of said sheet material from the film as said laminate is unwound from said second roller such that said sheet material may be rewound upon said first roller while the film containing the visible images is directed to a location outside of the film cassette; and means for preventing rotation of said first roller in said first direction until said loading door has been moved to said open position.

8. A disposable, manually operable, film processor as defined in claim 7 wherein said facilitating means comprises a third roller.

9. A disposable, manually operable, film processor as defined in claim 7 wherein said manually operable member comprises a crank.

10. A disposable, manually operable, film processor of the type specifically constructed to be disposed of after its processing materials have been depleted, the processor being adapted for use in the processing of a length of photographically exposed, self-developing type film, said film processor comprising:

a housing defining a lighttight chamber, said housing including means defining a loading door which is movable from a closed position to an open position for providing access to said chamber;

a first roller rotatably supported within said chamber for rotation in first and second directions, said first roller including drivable means adapted to be engaged by a manually operable member for rotating said first roller in said first direction;

a length of sheet material having first and second opposite ends, said length of sheet material being wound upon said first roller with said first end secured to said first roller and said second end being attached to a second roller;

a second roller rotatably supported within said chamber for rotation about its axis, said second roller including drivable means adapted to be engaged by a manually operable member for rotating said second roller;

a film assemblage of the 35 mm type including a cassette having therein a roll of unexposed self-developing type film, said film including a leader which is adapted to extend to the exterior of said cassette via a slot therein for attachment to said second roller subsequent to said film being photographically exposed;

an enclosure for hermetically sealing said film assemblage within said chamber, said enclosure including a removable cap for enabling removal of said film assemblage from said enclosure for subsequent photographic exposure of said film;

means for supporting said film assemblage, after exposure of said film, with said leader attached to said second roller;

a supply of processing composition;

an applicator monted in said chamber in communication with said supply of processing composition for applying a coating to one side of said sheet material; and said cover includes a manually operable member engageable with said drivable means of said second roller for rotating it in a direction, after said loading door has been moved to said closed position, so as to unwind said sheet material from said first roller and move it past said applicator where a coating of said processing composition is applied to one side of said sheet material, said rotation of said second roller also being effective to withdraw said exposed film from said cassette and wind it upon said second roller in engagement with the coated surface of said sheet material so as to form a laminate which is to remain wound upon said second roller for a period of time sufficient for visible images to be formed in said film.

11. A disposable, manually operable, film processor as defined in claim 10 wherein said supply of processing composition includes a container and said loading door includes means for causing said processing composition to leave said container as said loading door is moved toward its closed position so as to permit said processing composition to enter said applicator.

12. A disposable, manually operable, film processor as defined in claim 11 wherein said container is rupturable.

13. A disposable, manually operable, film processor as defined in claim 10 further including means for preventing rotation of said first roller in said first direction by said manually operable member until said loading door has been moved into said open position.

14. A disposable, manually operable, film processor as defined in claim 13 wherein said first roller includes at one end thereof a radially extending generally planar flange and said preventing means includes a resilient portion of said flange which normally extends out of the general plane of said flange into engagement with a stop on a wall of said chamber to thereby prevent rotation of said first roller in said first direction, and said loading door includes means for camming said resilient portion into the general plane of said flange as said loading door is moved into said open position thereby enabling rotation of said first roller in said first direction.

15. A disposable, manually operable, film processor as defined in claim 10 wherein said manually operable member is adapted to be engaged with said drivable means of said first roller, after said period of time has elapsed and said loading door has been moved to said open position, for rotating said first roller in said first direction thereby withdrawing said laminate from said first roller.

16. A disposable, manually operable, film processor as defined in claim 15 further including means for facilitating stripping of said sheet material from the film as said laminate is unwound from said second roller such that said sheet material may be rewound upon said first roller while the film containing the visible images is directed to a location outside of the film cassette.

17. A disposable, manually operable, film processor as defined in claim 16 further including means for preventing rotation of said first roller in said first direction until said loading door has been moved to said open position.

18. A disposable, manually operable, film processor as defined in claim 16 wherein said facilitating means comprises a third roller.

19. A disposable, manually operable, film processor as defined in claim 10 wherein said manually operable means includes means for preventing rotation of either of said first or second rollers in said second direction.

* * * * *